US006446633B2

(12) United States Patent
Coleman et al.

(10) Patent No.: US 6,446,633 B2
(45) Date of Patent: Sep. 10, 2002

(54) TOBACCO BALE SLICING APPARATUS AND METHOD

(75) Inventors: G. A. John Coleman, Richmond, VA (US); Joe A. Frady, Rocky Mt., NC (US)

(73) Assignee: Universal Leaf Tobacco Co., Inc., Richmond, VA (US)

( * ) Notice: Subject to any disclaimer, the term of this patent is extended or adjusted under 35 U.S.C. 154(b) by 0 days.

(21) Appl. No.: 09/976,062

(22) Filed: Oct. 15, 2001

Related U.S. Application Data

(62) Division of application No. 09/484,209, filed on Jan. 18, 2000, which is a division of application No. 09/163,182, filed on Sep. 30, 1998, now abandoned.

(60) Provisional application No. 60/061,404, filed on Sep. 30, 1997.

(51) Int. Cl.[7] ..... A24B 3/10; B66C 3/00

(52) U.S. Cl. ..... 131/290; 414/785

(58) Field of Search ..... 131/290, 322, 131/319; 414/785; 225/93; 241/605; 294/120, 126

(56) References Cited

U.S. PATENT DOCUMENTS

| | | | |
|---|---|---|---|
| 3,948,277 | A | 4/1976 | Wochnowski et al. |
| 3,978,868 | A | 9/1976 | Thiele et al. |
| 4,004,594 | A | 1/1977 | Wochnowski et al. |
| 4,222,397 | A | 9/1980 | Brackman et al. |
| 4,628,948 | A | 12/1986 | Beard et al. |
| 4,733,676 | A | 3/1988 | Fisk et al. |
| 5,117,844 | A | 6/1992 | Spicer et al. |
| 5,193,556 | A | 3/1993 | Lasch et al. |
| 5,240,013 | A | 8/1993 | Johnson et al. |

FOREIGN PATENT DOCUMENTS

| | | |
|---|---|---|
| EP | 0 101 271 | 2/1984 |
| EP | 0 511 196 A1 | 10/1992 |

*Primary Examiner*—Jose Fortuna
*Assistant Examiner*—Dionne A. Walls
(74) *Attorney, Agent, or Firm*—Pillsbury Winthrop LLP

(57) ABSTRACT

The present application relates to a tobacco bale splitting apparatus for splitting a bale of compressed tobacco having a plurality of generally parallel tobacco leaves having stems. The present application also relates to a method of splitting a tobacco bale.

11 Claims, 9 Drawing Sheets

FIG. 5

| | 1 | 2 | 3 | 4 | 5 | 6 |
|---|---|---|---|---|---|---|
| | OPERATION | STROKE | TIME | SECS | SECS | SECS |
| | | | | 0 | 10 | 20 |
| 1 | INSERT FIRST PENETRATION STRUCTURE | 48" PULL | 4.5 SECS | | | |
| 2 | INSERT SECOND PENETRATION STRUCTURE | 48" PULL | 4.5 SECS | | | |
| 3 | RAISE FIRST PENETRATION STRUCTURE | 18" PUSH | 2.4 SECS | | | |
| 4 | RETRACT SECOND PENETRATION STRUCTURE | 48" PUSH | 6.3 SECS | | | |
| 5 | RUN THE CONVEYOR | | 5.0 SECS | | | |
| 6 | LOWER FIRST PENETRATION STRUCTURE | 30" PULL | 2.8 SECS | | | |
| 7 | RETRACT FIRST PENETRATION STRUCTURE | 48" PUSH | 6.3 SECS | | | |
| 8 | RAISE FIRST PENETRATION STRUCTURE | 12" PUSH | 1.6 SECS | | | |
| | | | | | | |
| | | | | | | |

TOBACCO BALE SLICING APPARATUS AND METHOD

The present application is a division of application Ser. No. 09,484,209, filed Jan. 18, 2000, which is a division of application Ser. No. 09/163,182, filed Sep. 30, 1998, now abandoned, which claims priority to U.S. provisional application Serial No. 60/061,404, filed Sep. 30, 1997, the entirety of each of which are hereby incorporated into the present application by reference.

The present invention relates to an apparatus for slicing leaf tobacco bales.

Leaf tobacco bales are typically maintained in a highly compressed state which has many advantages over other methods of packing tobacco. One advantage is that the compressed leaves retain moisture longer than they would in a non-compressed state which makes conditioning and separating the tobacco leaves easier. After tobacco is picked, it is cured in an environment in which the humidity, temperature and other environmental variables are tightly controlled which allows the tobacco to cure without excessive desiccation. Once the proper curing and moisture content is established, the leaves are packed for shipment from the farm or baling site to a processing site. Packing the leaves in leaf bale assemblies maintains the moisture content in a manner superior to wrapping the leaves in sheets so the leaves can be conditioned and separated without undergoing the conventional vacuum conditioning step, the advantages of which will be described hereinbelow. Another advantage to compressing the leaves is that compressed leaves take up less storage space than do non-compressed leaves which results in substantial savings in storage and transportation costs when the tobacco is shipped for later processing. The bale assemblies can also be easily loaded into and out of a vehicle using a forklift and can be stacked, thus requiring less storage space.

This method of packaging tobacco leaves is an improvement over the traditional methods of packing leaves for processing including the conventionally used method of transporting the tobacco leaves wrapped in sheets of material. According to this method, approximately 300 tobacco leaves are placed on a burlap sheet, the sheet is wrapped around the tobacco to form a loose bundle and the bundle is tied. Tobacco packaged in this manner is sometimes referred to as "sheeted tobacco". This loose method of packing the tobacco exposes the leaf surfaces to the ambient atmosphere which allows water vapor to escape from the leaf at a rate faster than that for compressed leaves and this is a reason why the conventional method of conditioning sheeted tobacco includes a vacuum conditioning step. This loose method of packing in sheets also increases handling and transportation costs and requires greater storage volume prior to processing.

Although this method for packing tobacco in tobacco bale assemblies enables the tobacco producer or processor to reduce transportation costs and better protect the leaves and maintain the moisture content thereof, the tobacco arrives at the processing site for conditioning in a highly compressed state. To make the processing easier, it is often desirable to split the bales into slices before the tobacco is processed. To make the baled leaves more amenable to conditioning, a tobacco bale splitter assembly constructed in accordance with the principles of the present invention can be used for splitting these dense bales into a plurality of slices.

Bale splitter assemblies have been conventionally used for separating bales of "strip" tobacco into smaller slices for processing. Strip tobacco is processed tobacco broken down into small particles with the stems removed. Typical bale splitters use a plurality of prongs which penetrate the strip tobacco bale and separate a slice therefrom. Separating a bale slice from a strip tobacco bale is relatively easy because the tobacco has already been processed and the stems removed. In fact, oftentimes the bale will tend to split along "grains" defined by the compressed tobacco within the bale.

In contrast, conventional bale splitters are not readily adapted to split bales of leaf tobacco in an effective manner. The presence of stems in leaf tobacco bales presents certain difficulties to conventional bale splitters. Bale splitters which penetrate the bale with only one set of prongs and lift off the slice are unsatisfactory because the nature of the leaves and stems will result in an unclean separation. In fact, as the splitter nears the bottom of the bale, the entire remainder of the bale may be lifted instead of separating a slice because of the strength of the stems extending between the slice to be cut and the portion remaining.

Conventional bale splitters which use a pair of cooperating sets of prongs are also unsatisfactory because the two sets penetrate the bale on the same plane. The idea of this type of arrangement is to hold one set of prongs stationary while the other set separates the slice, thereby providing a cleaner separation than would be realized with one set of prongs. However, because the sets of prongs penetrate the bale on the same plane, the stems will intertwine with the two sets and make separation difficult. Due to the intertwining, more power is needed to sever the stems to effect full separation of the slice. In fact, experimentation has shown that the prongs can even bend if enough stems become intertwined.

One method for splitting tobacco leaf bales is to sever a slice from the bale in the vertical direction using a guillotine-like blade. One problem with such an arrangement is that the blade must be kept sharpened for proper use. If the blade is not kept sharpened, the blade will compress and deform the bale on its cutting stroke rather than cut through the bale. This compression and deformation can damage the tobacco and create difficulties in handling the bale. Also, the costs and maintenance associated with such an arrangement is also rather high.

Therefore, it is an object of the present invention to provide a bale slicing apparatus which can effectively separate slices from bales of leaf tobacco. In order to achieve such an object, there is provided a tobacco bale slicing apparatus for slicing a bale of compressed tobacco having a plurality of generally parallel tobacco leaves having stems. The apparatus comprises first bale penetrating structure having a plurality of prongs constructed and arranged to penetrate the bale generally parallel to the flattened tobacco leaves. Second bale penetrating structure has a plurality of prongs constructed and arranged to penetrate the bale generally parallel to the flattened tobacco leaves.

A penetrating structure moving assembly has structure constructed and arranged to (1) move the first penetrating structure generally perpendicularly relative to the flattened tobacco leaves to a first pre-penetrating position wherein the prongs thereof are disposed outside of the bale and at a first level spaced generally perpendicularly to the tobacco leaves from an edge of the bale and corresponding to a desired thickness of a bale slice to be separated from the bale and (2) move the second penetrating structure generally perpendicularly to the flattened tobacco leaves to a second pre-penetrating position wherein the prongs thereof are disposed outside of the bale and at a second level offset relative to the first level in a direction extending generally perpendicularly to the tobacco leaves. The penetrating structure moving assembly has structure constructed and arranged to move the bale penetrating structures from the respective first and second pre-penetrating positions generally parallel to the flattened tobacco leaves to respective first and second penetrated positions wherein the first and second penetrating structure prongs penetrate the bale at the first and second levels so as to define the aforesaid bale slice of the desired thickness and a remaining portion of the bale.

The penetrating structure moving assembly having structure constructed and arranged to move the first and second bale penetrating structures relatively away from one another generally perpendicularly to the flattened tobacco leaves so as to separate the bale slice from the remaining portion of the bale after the first and second penetrating structure prongs have penetrated the bale. A bale slice moving assembly has structure constructed and arranged to move the separated bale slice away from the remaining portion.

According to another aspect of the present invention there is provided a method for slicing a tobacco bale having a plurality of generally parallel flattened tobacco leaves. The method comprises the steps of providing a first bale penetrating structure having a plurality of prongs and a second bale penetrating structure having a plurality of prongs. The first penetrating structure is moved generally parallel to the flattened tobacco leaves so that the prongs thereof penetrate the bale at a first level spaced generally perpendicularly to the tobacco leaves from an edge of the bale and corresponding to a slice of desired thickness to be separated from the bale. The second penetrating structure is moved generally parallel to the flattened tobacco leaves so that the prongs thereof penetrate the bale at a second level offset relative to the first level in a direction extending generally perpendicular to the flattened tobacco leaves. The first bale penetrating structure is moved relatively away from the second bale penetrating structure generally perpendicularly to the flattened tobacco leaves so as to separate the slice of desired thickness from the bale. Then, the slice is moved away from the bale.

According to yet another aspect of the present invention, there is provided a method for processing a compressed tobacco bale having a plurality of substantially whole, generally parallel flattened tobacco leaves with stems. The method comprises the following steps. Successive portions are removed from the bale to be conditioned. The removed portions are successively supplied in substantially the form removed from the bale to an interior of a rotatable direct conditioning cylinder. The cylinder has a plurality of tobacco separating structures on the interior thereof. The direct conditioning cylinder is continuously rotated so that the tobacco separating structures break up the successively supplied portions by lifting and separating the leaves of the successively supplied portions from one another. The leaves of the successively supplied portions are continuously conditioned in the direct conditioning cylinder by supplying heat and moisture to the leaves while the cylinder rotates. Conditioned leaves are continuously discharged from the direct conditioning cylinder. The method according the present aspect of the invention is not limited to the apparatus described in the following detailed description and it is contemplated that the above-mentioned guillotine-like vertical blade may be used to remove portions from the bale.

Other objects, features, and advantages will become apparent from the following detailed description, the accompanying drawings, and the appended claims.

BRIEF DESCRIPTION OF THE DRAWINGS

FIG. 5 is a table and time graph describing a sequence of steps that the bale splitting assembly can perform to split the tobacco bale;

DETAILED DESCRIPTION OF THE PREFERRED EMBODIMENT SHOWN IN THE DRAWINGS

Figure 1:
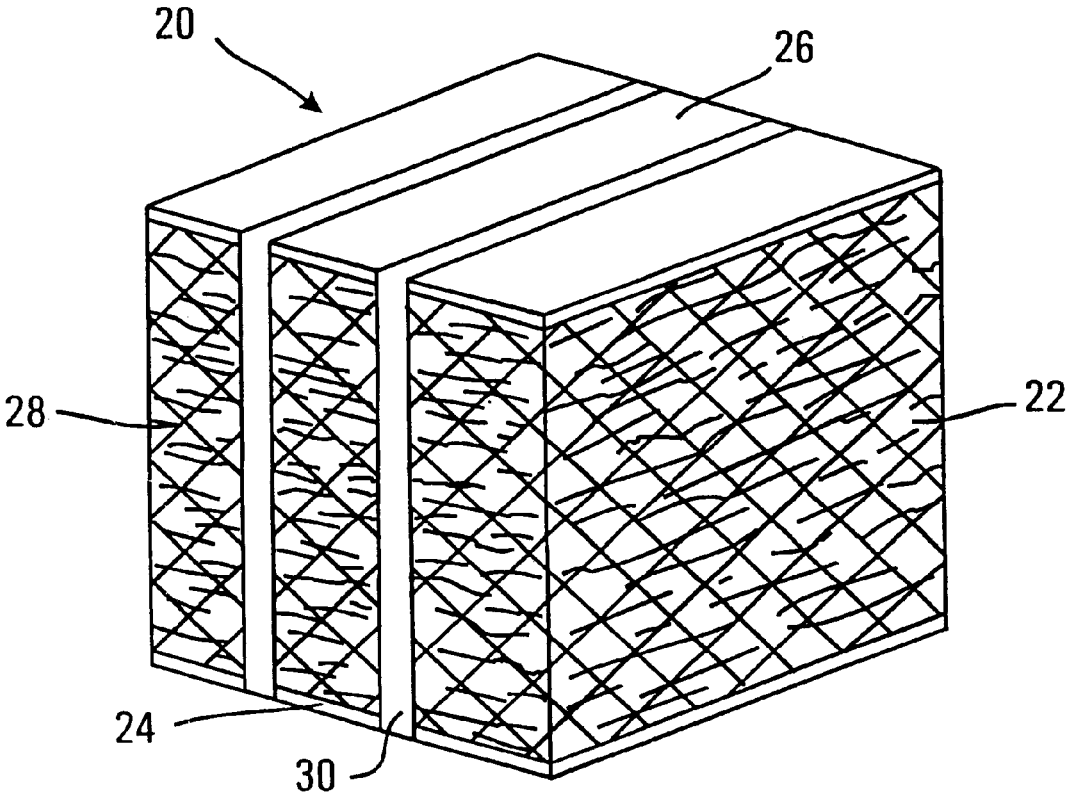
FIG. 1 is a perspective view showing a tobacco bale assembly in accordance with the present invention.

Referring now more particularly to the drawings, there is shown in FIG. 1 a perspective view of the preferred embodiment of a tobacco bale assembly, generally designated by the reference numeral 20 which includes a tobacco bale 22, a bale base member 24, a bale top member 26, a bale covering structure 28 and a plurality of elongated bale fastener members 30. The tobacco bale 22 is comprised of a plurality of compressed whole tobacco leaves arranged with the stems thereof substantially parallel to each other and the leaf surfaces thereof substantially parallel to each other. The force that compresses the whole tobacco leaves into a dense bale is applied in a direction perpendicular to the parallel leaf surfaces. The compressed bale can assume a wide variety of shapes and a wide range of sizes but the preferred shape is cuboid and the preferred size is about forty six inches on each side. A 46"×46"×46" bale of compressed leaves typically weighs about 1200 pounds. The tobacco bale 22 in FIG. 1 is placed on the bale base member 24 so that the open and flat leaf surfaces are parallel to the top surface of the base member 24.

The base member 24 is preferably a right rectangular piece of one inch plywood. The top surface of the base member 24 preferably has essentially the same dimensions as the bottom surface of the bale 22 so the bale completely covers base when placed thereupon. The top member 26 has preferably the same size and structure as the base member 24 and is placed on the top surface of the baled tobacco leaves 22 and the bale covering structure 28 is secured around at least the peripheral sides of the bale assembly 20, covering the exposed edges of the tobacco leaves. The preferred embodiment of the covering structure 28 is a net-like mesh structure comprised of a flexible and resilient material and the preferred embodiment of the top member 26 is comprised of a plurality of wooden boards which cooperate to form an essentially square planar member the bottom surface of which preferably has the same dimensions as the top surface of the bale 22. The mesh covering 28 may be secured to the assembly in a plurality of ways including using conventional fasteners such as staples or nails to fasten the same to top member 26 and the base member 24 or it may be shrink-wrapped around the peripheral sides of the bale, or both. The bale covering structure 28 can be one continuous piece or several separate pieces.

The plurality of elongated bale fastener members 30 are wrapped around the bale assembly 20 to hold the top member 26 and the base member 24 tightly against the tobacco bale 22 and maintain the structural integrity of the bale assembly 20 during transport. The elongated bale fastener members 30 are preferably two steel bands that are wrapped around the bale assembly in the substantially parallel configuration shown in FIG. 1.

Figure 2:
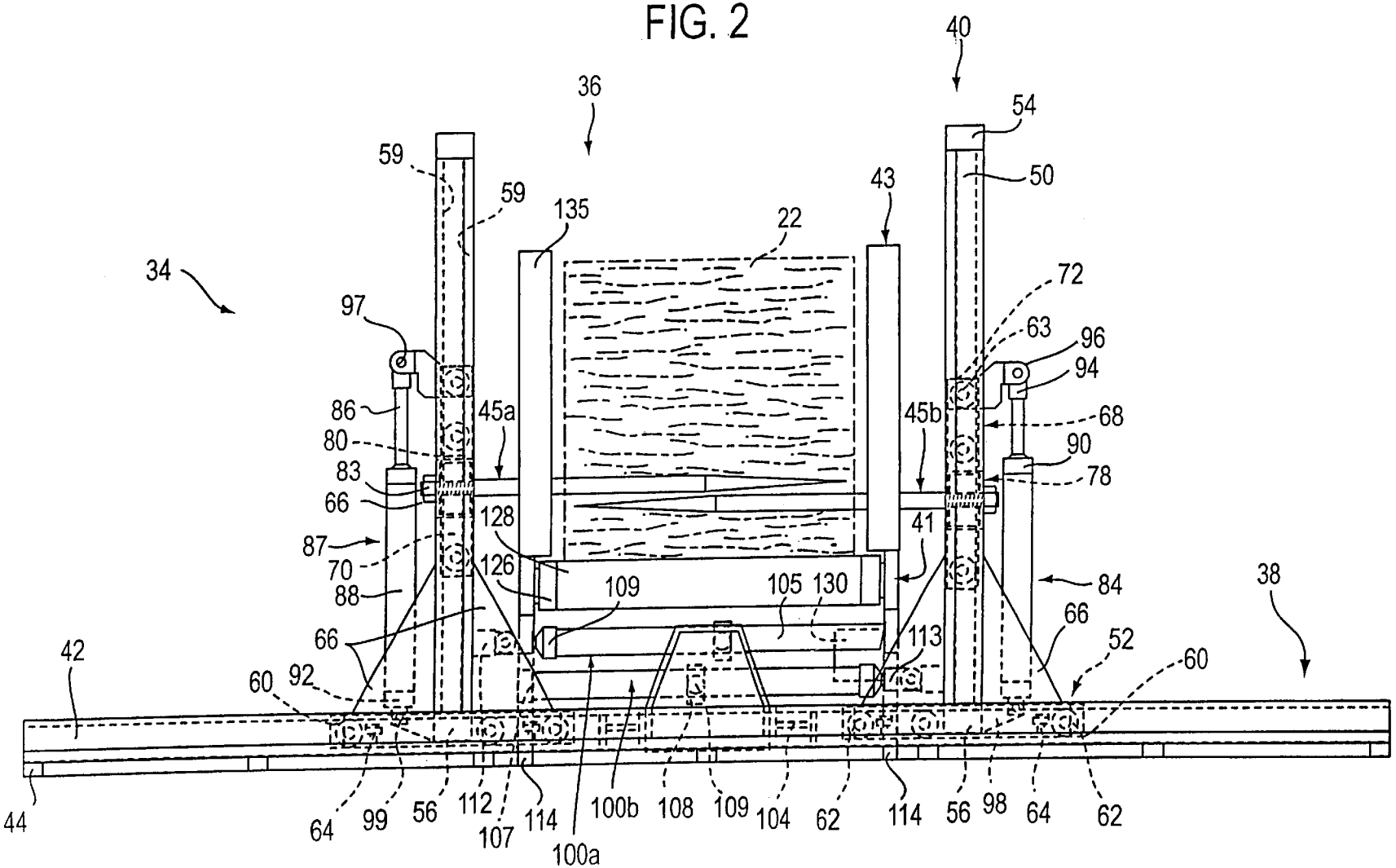
FIG. 2 is an end elevational view of a bale splitting assembly in accordance with the present invention showing a bale of tobacco in phantom within the bale splitting assembly.
Figure 3:
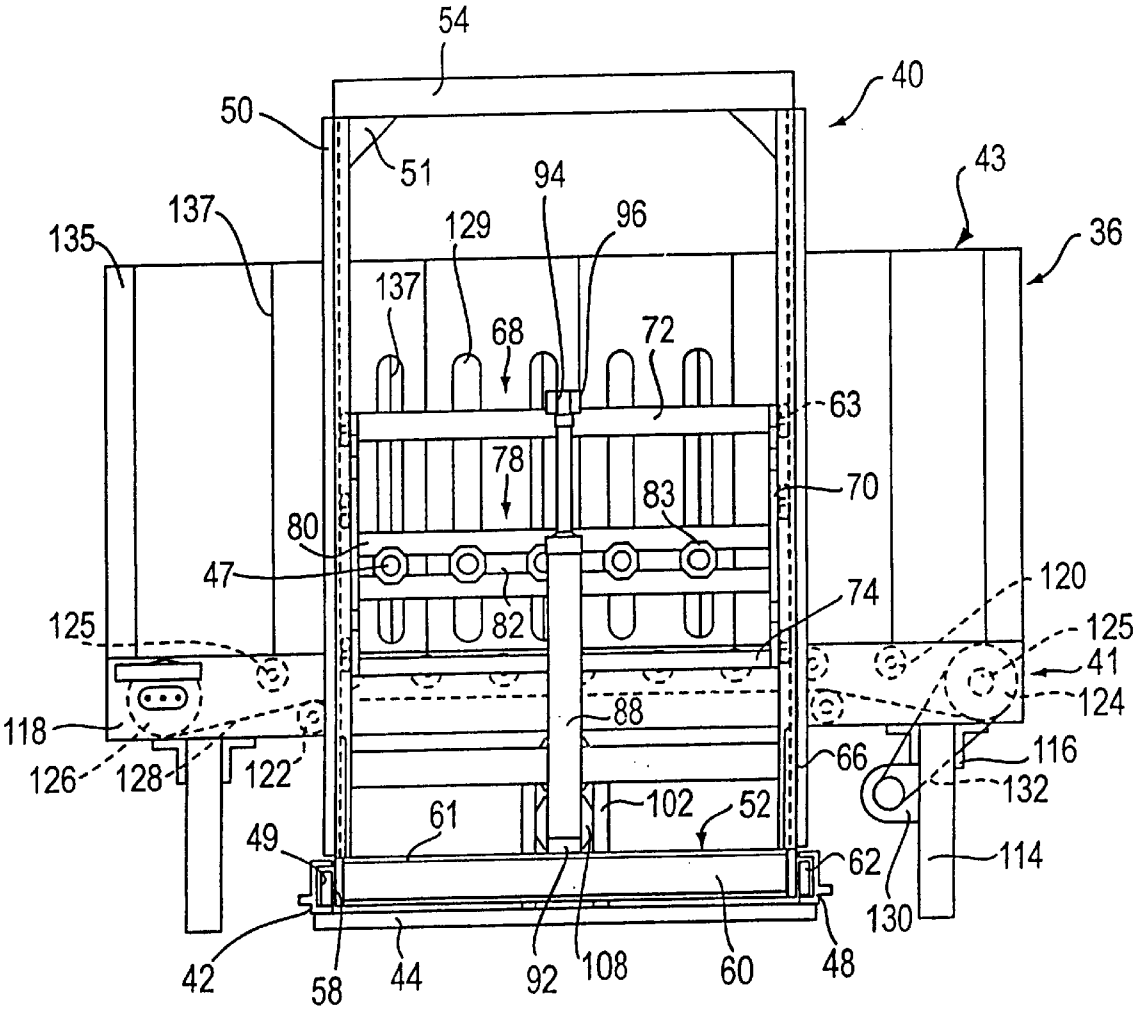
FIG. 3 is a side elevational view of the bale splitting assembly.
Figure 4:
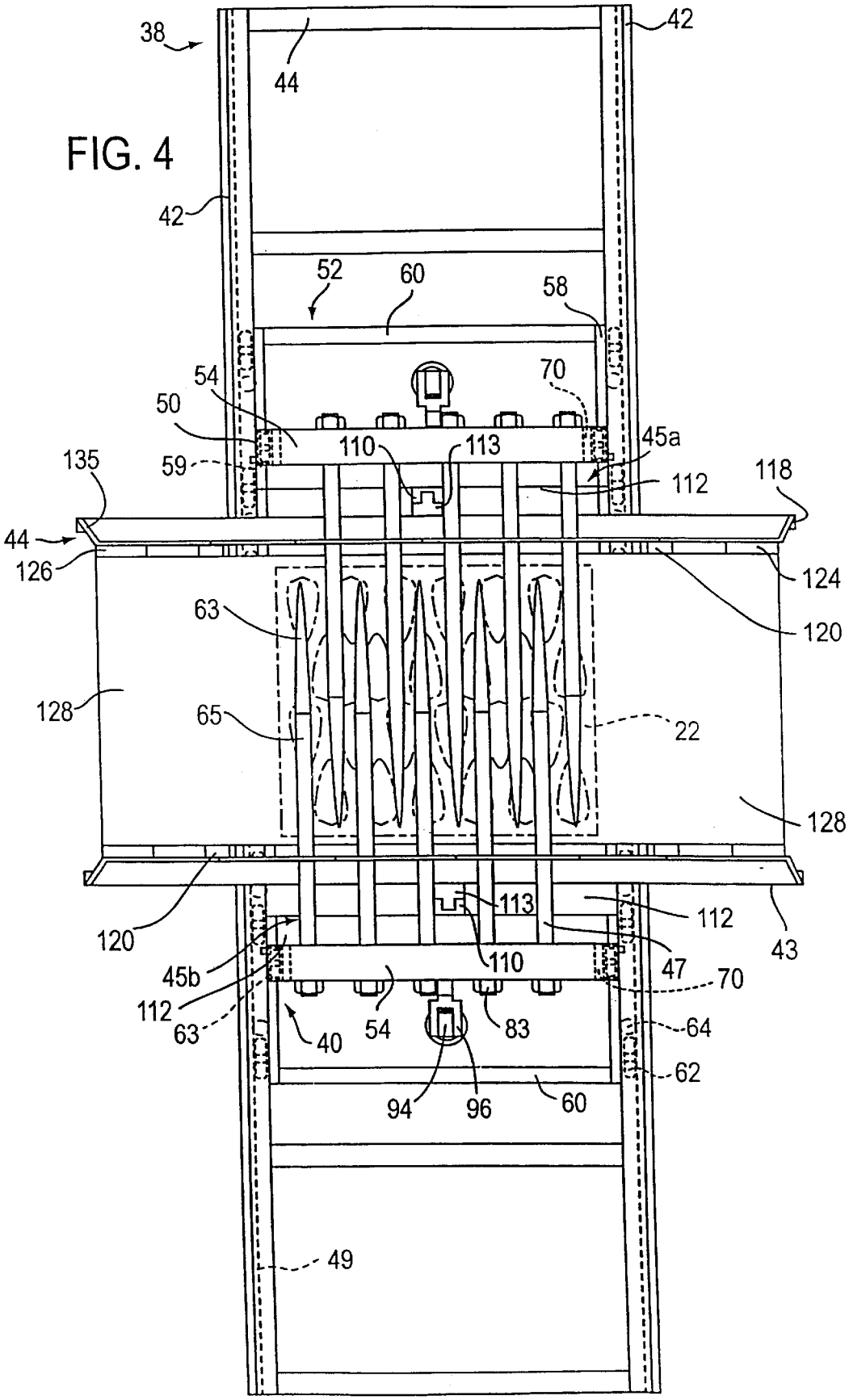
FIG. 4 is a top plan view of the bale splitting assembly with the tobacco bale shown in phantom.

The preferred embodiment of a tobacco splitter assembly for splitting the dense bales of tobacco leaves is generally designated 34 and is shown in FIGS. 2–4. The tobacco splitter assembly includes a housing structure, generally designated 36, and an elongated horizontal track assembly, generally designated 38, extending transversely under and on opposite sides of the housing structure 36 and two vertical track assemblies, generally designated 40, each of which is rollingly supported on the horizontal track assembly 38 and which are positioned on opposite sides of the housing structure 36. A bale of tobacco leaves 22 is shown in phantom supported on a longitudinally extending bale conveyor assembly, generally designated by the reference numeral 41, that forms a middle portion of the housing structure 36 and which extends from a first end of the housing structure 36 to a second end thereof and which is positioned between a plurality of apertured side wall members 43. Two elongated horizontally extending bale penetrating structures 45*a* and 45*b*, each of which is comprised of a plurality of identical equally spaced parallel linear penetration members 47, are movably disposed adjacent the housing structure 36 with one set on either side thereof to work on the bale of tobacco 22. The details of the structures supporting the linear members 47 will be discussed hereinbelow after the general configuration of the horizontal and vertical track assemblies is explained.

The horizontal track assembly 38 includes two parallel coplanar horizontal track members 42, which are supported and held in spaced relationship by a plurality of identical transverse horizontal track spacer members 44. The inner side surface of each horizontal track member 42 defines a plurality of roller path structures best seen in the end view of FIG. 3 including a horizontally extending upwardly facing support roller path 48 and a vertically extending inwardly facing guide roller path 49.

The two vertical track assemblies 40 are oppositely facing structures which are rollingly supported by a plurality of carrier assemblies on opposite ends of the horizontal track assembly 38 on opposite sides of the housing structure 36 to effect the horizontal movement of each of the vertical assemblies 40 toward and away from the housing structure 36. Each vertical track assembly 40 includes two parallel vertical track members 50, a vertical track carrier assembly generally designated 52, an elongated transverse vertical track end member 54 and an elongated transverse vertical track base structure 56. The vertical track end members 54 and the vertical track base structures 56 are secured across the top and bottom ends, respectively, of each pair of vertical track members 50 to hold them in parallel spaced relation. Each vertical track end member 54 is further secured to a respective vertical track member 50 by a comer support member 51. Each vertical track carrier assembly 52 is essentially a horizontally oriented rectangular frame structure that is rolling supported on the horizontal track assembly 38 by a plurality of roller members and to which a pair of vertical track members 50 is rigidly secured.

Each carrier assembly 52 includes two carrier side support structures 58 and two carrier end structures 60. Each carrier side support structure 58 is provided with a plurality of support roller members 62 and a plurality of guide roller members 64. Preferably, each carrier side support structure 58 has three support roller members 62 and two guide roller members 64. Each pair of carrier end structures 60 holds each member of a pair of oppositely facing carrier side support structures 58 adjacent the roller path structures 48 and 49 so that the support roller members 62 on each side structure 58 is rollingly supported on each horizontal surface 48 on a horizontal track member 42 and each pair of guide roller members 64 rollingly engages an inwardly facing vertical roller path 49 to guide the movement of the plurality of side structures 58 during horizontal movement along the horizontal track assembly 38 in a manner well known in the art. Each carrier end structure 60 is an essentially elongated planar rectangular member which is provided along its top and bottom edges with upper and lower flange members extending perpendicularly outwardly therefrom. The flange members each extend outwardly on the same side of the elongated planar rectangular member and structurally reinforce the same. As seen in FIG. 3, each carrier end structure 60 is secured to the side structures 58 so that the flange members 61 extend outwardly toward the ends of the carrier assembly 52.

Each track carrier assembly 52 is rollingly engaged at opposite ends of the horizontal track assembly 38 on opposite sides of the housing structure 36. Each vertical track base structure 56 is rigidly connected between median portions of the inner surfaces of oppositely facing pairs of carrier side support structures 58. Each vertical track end member 54 and each base structure 56 is an elongated, essentially rectangular structure as best seen in FIG. 2. Each pair of parallel vertical track members 50 is held in parallel coplanar spaced relationship through rigid attachment to the transverse vertical track end member 54 at the upper ends thereof and the transverse vertical track base structure 56 at the lower ends thereof. An elongated inner side of each vertical track member 50 defines a plurality of vertical roller path surfaces including two identical parallel vertically extending opposing surfaces 59. Each pair of vertical track members 50 is held rigidly upright in a track carrier assembly 52 by the aforementioned rigid attachment to a respective vertical track base structure 56 and by a plurality of carrier support members 66 which are secured in pairs between a lower portion of each vertical track member 50 of each vertical track assembly 40 and each side structure 58.

A vertical frame assembly 68 is rollingly mounted within each vertical track assembly 40 and each bale penetrating structure 45*a* and 45*b* is rigidly mounted within a vertical frame assembly 68. Each vertical frame assembly 68 includes a pair of frame side support members 70, an elongated transverse upper support structure 72 and an elongated transverse lower support structure 74. An upper support structure 72 is rigidly secured between the upper ends of each pair of the side support members 70 and a lower support structure 74 is rigidly secured between the lower ends of each pair of oppositely facing side support members 70 of each vertical frame assembly 68 and these support structures 72 and 74 cooperate to hold each of the side support members 70 adjacent the two identical parallel vertically extending opposing roller path surfaces 59 on each vertical track member 50 so that a plurality of rollers 63 rotatably attached to the side support members 70 can rollingly engage the vertical track assembly 40 to guide the vertical movement of the vertical frame assemblies 68 with respect to the vertical track assemblies 40.

An elongated transverse middle support assembly 78 is rigidly secured within each vertical frame assembly 68 to a median portion of the inner surface of each oppositely facing frame side support members 70. Each middle support assembly 78 is preferably comprised of a pair of identical elongated rectangular planar middle support members 80 each having a pair of identical outwardly perpendicularly extending flange structures which give the support member 80 an essentially U-shaped cross section. The two middle support members 80 which are mounted within the frame assembly 68 with the U-shaped openings directed towards each other to form two identical, aligned elongated openings 82 on opposite sides of the frame assembly 68, one of which is shown in FIG. 3. These aligned openings 82 cooperate to form an attachment passage for the plurality of linear members 47 secured to each vertical frame assembly 68.

Each linear penetration member 47 is preferably an essentially cylindrical structure defining a pointed first end portion 63, a cylindrical median portion 65 and a threaded second end portion 67, but the threaded end portion 67 is slightly smaller in diameter than an immediately adjacent cylindrical portion 65. The linear structures 47 are mounted to the middle support assembly 78 to form the two bale penetrating structures 45*a* and 45*b* by positioning the threaded end 67 of each structure through the aligned openings 82 and placing a bolt member 83 on each threaded end portion. The linear structures 47 are equally spaced along the opening 82 but are offset to one end of the support assembly 78 so that when the vertical frame assemblies 68 are mounted in the oppositely facing vertical track assemblies 40, none of the linear members 47 which comprise the penetration structure 45 on one of the vertical track assemblies 40 is collinear with any of the linear members 47 which comprise the penetration structure 45 on the opposite vertical track assembly 40. This is important because this offset configuration of the opposing penetration structures 45*a* and 45*b*, which is best seen in the top plan view of FIG. 4, makes it possible for these structures to be positioned over the conveyor assembly 41 at the same time and raised or lowered without the linear members 47 on opposite structures 45*a* and 45*b* coming into contact. This offset relationship is best understood by referring to the top view of the bale splitter assembly in FIG. 4 which show both of the structures to be positioned over the conveyor assembly 41 at the same time without the linear members 47 on opposite structures 45*a* and 45*b* coming into contact.

Each vertical frame assembly 68 is movably supported within a respective vertical track assembly 40 for vertical movement therein by a vertical movement assembly, generally designated 84. Each vertical movement assembly 84 is an elongated vertically extending structure capable of linear expansion and contraction and is positioned to be essentially parallel to and essentially equidistant from each track member in a pair of vertical track members 50 on the side thereof away from the housing structure 36.

Each vertical movement assembly 84 includes an elongated rod member 86, a casing assembly generally designated 87, an apertured end member 94, an upper holder member 96 and a lower holder member 98. The casing assembly 87 is comprised of a casing body structure 88, an upper open cap structure 90 and a lower closed cap structure 92. Each lower holder member 98 is secured to a middle portion of the track base structure 56 so that the member 98 is positioned between the vertical track members 50 on a side of the vertical track assembly facing away from the housing structure 36. The upper holder member 96 is secured to a middle portion of the upper support structure 72 of the vertical frame assembly 68 so that it is equidistant from the two side support members 70 thereof and on the side of the vertical frame assembly 68 away from the housing structure.

The upper and lower holder members 96 and 98 are vertically aligned and are each provided with a pair of equal diameter aligned transverse throughgoing apertures which receive a pin member 97 to pivotably support the end member 92 and 94, respectively, on the elongated rod member 86 and the casing body structure 88, respectively, as will be explained hereinbelow. The upper open cap structure 90 is secured to an upper end of the casing body structure 88 and is provided with an opening to slidably receive the rod member 86 and allow passage of a free end thereof toward and away from of the casing body structure 88. The lower cap structure 92 seals the lower end of the casing body structure 88 and is provided with a downwardly directed elongated apertured portion to pivotably secure the assembly 87 to the aligned transverse throughgoing apertures on the lower holder member 98 with a pin member 99 in a manner well known in the art. The apertured end member 94 is secured to the free end of the rod member 86 and provides the rod member 86 with an upwardly directed elongated apertured portion to pivotably secure the member 86 to the aligned transverse throughgoing apertures on the upper holder member 96 with a pin member 99 in a manner well known in the art. Each vertical movement assembly 84 moves horizontally with the vertical track assembly 40 to which it is attached as the respective track carrier assembly 52 moves along the horizontal track assembly 38. As the rod member 86 moves in or out of the case body structure 88, it lifts or lowers the attached vertical frame assembly 68 and the linear structures 45 attached thereto.

The horizontal movement of the vertical track assemblies 40 along the horizontal track assembly 38 is effected in a similar manner. A pair of identical oppositely directed horizontal movement assemblies 100*a* and 100*b* are positioned beneath the housing structure 36 and are oriented parallel to and slightly above the horizontal track members 42. The horizontal and vertical assemblies cooperate to define first and second penetrating structure movement assemblies for each of the penetrating structures. In fact, all of the movement assemblies could be considered together as being one penetrating structure movement assembly.

Each horizontal movement assembly 100 is equidistant from each horizontal track member 42, but the horizontal movement assembly which is designated 100*a* is positioned slightly above horizontal movement assembly designated 100*b* as is best seen in the end view of FIG. 2. The structure of assemblies 100*a* and 100*b* is identical. Each horizontal movement assembly 100 is held above the horizontal track assembly 38 between two identical parallel center attachment structures 102 which are positioned between the horizontal track members 42 and are secured to a transverse spacer member 44 and at the lower side portions thereof to identical first and second transverse cross support members 104. The first and second cross support members 104 are each secured to the inner side surfaces of the horizontal track members 42 but do not interfere with the movement of the track carrier assemblies 52 because the cross support members are under the housing structure 36 outside of the range of motion of the carrier assemblies 52. Each cross support member has an essentially I-shaped cross sectional configuration which is shown in phantom in FIG. 2.

Each horizontal movement assembly 100 has a structure similar to that of the vertical movement assemblies 84 and includes a casing body structure 105, a closed end cap member 107, an open cap structure 109, an elongated rod member 111 and an apertured end member 113. A retainer member 108 which surrounds the body structure 105 of each horizontal assembly 100 engages a plurality of cylindrical support members 109 which are mounted between the parallel center attachment structures 102 to hold the casing body structures 105 of the assemblies 100*a* and 100*b* therebetween. The closed cap structure 107 is secured to and seals one end of the body structure 105 and the open cap structure 109 is secured to the other end thereof and is provided with an opening to slidably receive the rod member 111 and allow linear movement of a free end thereof toward and away from of the casing body structure 105. An apertured end member 113 is secured to the free end of each rod member 111 and engages a pair of apertured parallel extension structures 110 on an inner linear transverse member 112 attached to a lower portion of each vertical track assembly on a side facing the housing structure 36. The inner linear transverse member 112 associated with assembly 100*a* is slightly higher that the inner linear transverse member 112 associated with assembly 100*b* so that each assembly 100*a* and 100*b* is substantially parallel to the horizontal tracks 42. Preferably a pin member is used to secure the aperture on the end member 113 to the aligned apertures on the extension structure 110 in a manner well known in the art. Horizontal movement of each vertical track assembly 40 is effected by the movement of a rod member 111 into or out of the casing body structure 105 which causes the respective track carrier assembly 52 to roll along the horizontal track assembly toward or away from the housing structure 36.

As shown in FIG. 2, the horizontal track structure 38 generally extends under the housing structure 36 in a direction transverse thereto. FIG. 3 shows a side view of the housing structure 36 in which the structures disposed along the length of the housing structure 36 can be seen. The housing structure 36 includes the conveyor assembly 41 and a plurality of apertured side wall members 43. The conveyor assembly 41 is held above the horizontal track assembly 38 by a plurality of leg members 114 rigidly attached thereto by a plurality of leg bracket members 116. The conveyor assembly includes two parallel conveyor side members 118, a plurality of housing rod members 125, a plurality of elongated top roller members 120, a plurality of elongated bottom roller members 122, an enlarged actuation roller member 124, an enlarged adjustable roller member 126 and a continuous loop member 128. The two parallel sides of the frame structure 118 are rigidly held in spaced relation by the plurality of housing rod members 125. The plurality of elongated top roller members 120, the plurality of elongated bottom rollers members 122, the enlarged actuation roller member 124 and the enlarged adjustable roller member 126 are rotatably mounted on the plurality of housing rod members 125 which are secured between opposite sides of the conveyor frame structure 118 to that the plurality of rod members 125 are positioned to rollingly support the continuous loop member 128. The plurality of top roller members 120 are equally spaced adjacent an upper edge of the frame structure 118 and cooperate with the end rollers 124 and 126 and the loop member 128 to form a support surface for a tobacco bale 22. The loop member 128 is tautly and rotatably held by the plurality of roller members. The enlarged actuation roller member 124 and the enlarged adjustment roller member 126 support the ends of the loop member 128 and a pair of bottom roller members 122 support the loop from below. A motor assembly 130 mounted beneath the conveyor assembly 41 rotates the loop member 128 by driving a continuous band structure 132 which frictionally engages the actuation roller 124 in a manner well known in the art. The tightness of the loop member 128 is adjusted by moving the adjustment roller 126 toward or away from the actuation roller 124 to respectively decrease or increase the loop tension.

The conveyor belt assembly 41 serves as a bale slice moving structure and moves the tobacco slice away from the bale. In the preferred embodiment of the invention, the conveyor belt assembly 41 serves both as a bale moving and supporting assembly for moving and supporting the bale and as the bale slice moving structure. It is contemplated, however, that the principles of the present invention may be applied to arrangements where the bale slice moving feature is not performed by an assembly which also supports and moves the bale. For example, the bale penetrating structures may remove slices from the top of the bale and a pusher device may be used to move the bale slice off after it is lifted off the bale. The embodiment disclosed herein is preferred, however, because cost savings are better achieved by performing both moving functions with one assembly. Two apertured side wall members 43 are rigidly attached to and coextensive with the conveyor frame structure 118 so that when the actuation roller 124 is rotated and the loop member 128 rotates in a continuous manner around the various roller members, the top surface of the loop member 128 travels past these apertured wall members 43. The ends of each apertured side wall member 43 extend angularly outward from the loop member 128 to form a plurality of identical flanged portions 135 of the side wall 43. This outward flaring of the side walls 43 serves a plurality of purposes, including preventing a tobacco bale that is entering the housing structure 36 from being caught on the side wall 43. The side walls 43 include a plurality of segments which are joined together at seams 137. A plurality of apertures 129 are formed in the wall members 43 which are wide enough to allow the linear penetration structures 45*a* and 45*b* to pass freely through the side walls 43 through the full horizontal extent of their range of movement and are elongated in a vertical direction to allow the linear structures 45*a* and 45*b* to move upward and downward through the full vertical extent of their range movement when the structures 45*a* or 45*b* are positioned over the top surface of the conveyor assembly 41. As can best be seen in FIGS. 3 and 4, the apertures in the side wall members 43 on each side of the conveyor assembly 41 and the associated linear members 47 are horizontally offset so that both horizontal penetration structures 45*a* and 45*b* can be raised and lowered independently when they are positioned over the conveyor assembly 41 without coming into contact with one another.

Operation of the Splitter

The movement of each horizontal penetration structure 45*a* and 45*b* is independent of the other and each structure is capable of simultaneous or sequential horizontal and vertical two-dimensional movement because each vertical frame assembly 68 within which each horizontal linear penetration structure 45 is rigidly mounted is movably mounted in one of the vertical track assemblies 40 and each vertical track assembly is in turn rollingly mounted on the horizontal track assembly 38 for horizontal movement toward and away from the housing structure 36. The vertical movement of either vertical frame assembly 68 and the horizontal movement of either track carrier assembly 52 is effected by the respective movement of a rod member 86 or 111 into or out of a casing body structure 88 or 105 in which it is slidably mounted. Each casing structure 88 or 105 is typically in fluid communication with a fluid pressure source to effect the bi-directional movement of the rod members 86 or 111, respectively, with respect to the casing body structure 88 or 111 in a manner well known in the art. The housing structure 36 is generally not movable, but the continuous loop member 128 rotatably held therein rotates when the actuation roller member 124 is rotated by the motor assembly 130. The motor assembly 130 is capable of bidirectional movement, but typically only uni-directional rotation of the loop member 128 is required during the splitting process.

The tobacco splitter assembly 34 can be controlled manually by a human operator through a plurality of switch assemblies which enable the operator to control the horizontal and vertical movement of each penetrating structure 45*a* and 45*b* and the rotation of the loop member 128. In the preferred embodiment, however, the movements of the penetrating structures 45*a* and 45*b* and the loop member 128 are controlled and coordinated by a programmable computer control unit called a programmable logic control (PLC) 175 which cooperates with a plurality of electronic and electromechanical devices including a bale position sensor in the form of a photo-electric eye assembly, and a plurality of proximity switches, but a human operator or inspector is provided with a switch or other means for temporarily taking over control of the processing operations from the PLC and thereby interrupting the operation of the tobacco splitter assembly and the plurality of devices cooperating therewith to correct a fault in the tobacco splitting process. The photo-electric eyes and the proximity switches are not shown in the drawings but their use to control one or several industrial processing devices is well known in the art.

Figure 10:
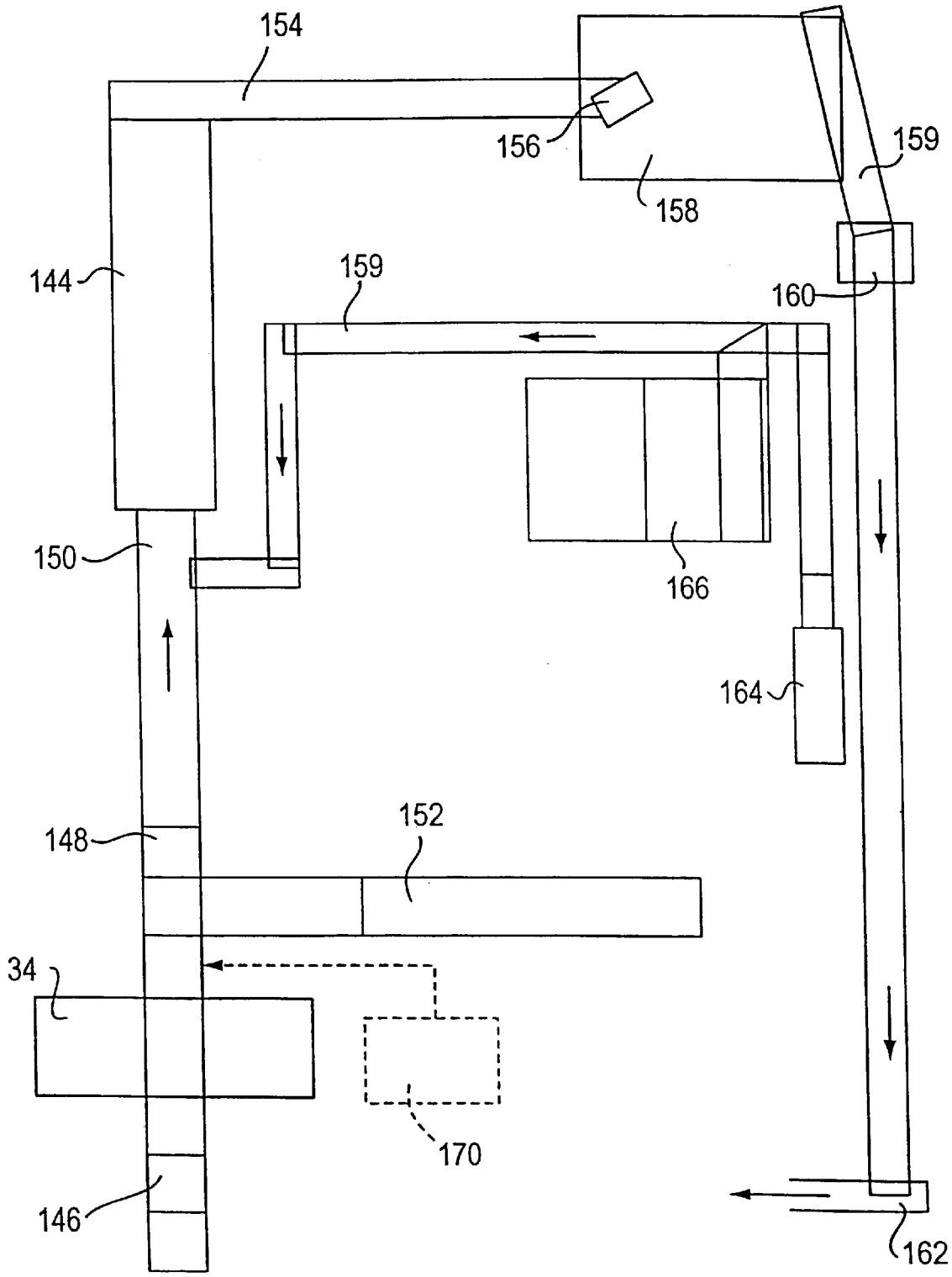
FIG. 10 is a schematic representation of a floor plan for effecting the preferred method described in FIG. 9 for separating and conditioning the tobacco from a tobacco bale showing the optional inspection in phantom.

The process of splitting a tobacco bale 22 begins by cutting and removing the elongated bale fastener members 30, the bale covering structure 28 and the bale top and base members, 26 and 24, respectively, as described hereinbelow and placing the bale 22 on a first end of the conveyor surface. The bale can be placed on the first end of the conveyor surface directly or through the cooperation of a separate bale feeding device. Specifically, a feed conveyor assembly 146, shown schematically in FIG. 10, is typically and preferably used to feed a series of unsplit bales into the tobacco splitter assembly 34 as will be explained below when the use of the splitter assembly 34 in the conditioning process is discussed. Because the tobacco bales are approximately 1200 pounds, a forklift is typically used to place the tobacco bale on the feed conveyor assembly. The PLC 175 can be used to control and coordinate both the tobacco splitter assembly and the feed conveyor assembly so that the feed conveyor assembly moves a tobacco bale into the tobacco splitter assembly 34 when the splitter is ready to receive the same. After the feed conveyor assembly places a bale on the continuous loop member 128, a control signal from the PLC activates the motor assembly 130 on the conveyor assembly and rotates continuous loop structure 128 until a signal from a photoelectric eye assembly, which detects the position of the bale within the housing structure 36, indicates that the bale 22 has advanced into the housing structure 36 until it is approximately centered with respect to the plurality of elongated vertically extending non-aligned apertures in each of the side walls 43. The phantom tobacco bale 22 shown in FIGS. 2 and 4 is in the centered position. A control signal from the PLC then switches off the motor assembly 130 and a series of subsequent control signals guides the penetration structures 45*a* and 45*b* through a series of movements to split the bale 22.

The operation of the tobacco splitter assembly 34 to split a compressed bale 22 of tobacco into slices will now be described with reference to a particular example described in tabular and graphic form in FIG. 5. The programmable logic control unit 175 can be and preferably is programmed to perform the sequence of steps listed in FIG. 5. FIG. 5 describes both the timing of a sequence of mechanical movements of the two horizontally extending penetration structures 45*a* and 45*b* after the bale has been centered on the splitter assembly 34 and the timing of the rotation of the loop member 128 to move a slice out of the splitter. It should be reemphasized that the PLC 175 could be programmed to perform more than just these steps and, more specifically, could be used to control other equipment at the same time that it is programmed to and being used to control the tobacco splitter assembly 34. The bale splitting assembly 34 can be used to split a bale 22 into a slices of the desired thickness. The thickness of the slices is set or determined by a plurality of proximity switches in a manner well known in the art.

It is assumed for the purposes of this example that a tobacco bale 22 has been loaded into the splitter 34 and is in the position shown in phantom in FIGS. 2–4 to be split by the structures 45*a* and 45*b* and that the continuous loop member 128 is motionless when the listed operations of FIG. 5 commence. It is also assumed the two horizontal structures 45*a* and 45*b* are initially positioned immediately before operation 1 in FIG. 5 is commenced as far from the bale conveyor assembly 41 in the horizontal direction as possible and that the second horizontal structure 45*b* is at a vertical penetrating position above the bale conveyor surface equal to the desired thickness of the slice of the tobacco bale 22. The preferred bale slice thickness is nine and one half inches so the initial penetrating position of structure 45*b* is 9.5 inches above the top surface of the conveyor surface upon which the bale 22 is resting.

The initial penetrating position of the other penetration structure 45*a* immediately prior to the commencement of operation 1 in FIG. 5 is also important and is preferably two and one half inches above the height of the lower structure 45*b* because each time the bale 22 is sliced, the opposing penetration structures 45*a* and 45*b* penetrate opposite sides of the bale preferably at substantially the same time. It will be recalled that the compressed leaves in the bale are flat and arranged so that the leaf surfaces and the leaf stems are parallel. The bale is placed in the tobacco splitter assembly 34 so that the leaf surfaces are parallel to the top surface of the conveyor assembly to enable the penetration structures 45*a* and 45*b* to be inserted between the cleavage planes formed by the leaf layers to slice the bale. Consequently, if the horizontal distance between the penetration structures 45*a* and 45*b* is too small, the flat, compressed parallel leaves are sheared by the action of the structures 45*a* and 45*b* penetrating the bale from opposite directions, which may damage the leaves, and an excess amount of power is required to penetrate the bale. Also, when the structures are too close together, the leave stems may intertwine with the prongs, thereby inhibiting clean slicing and, in the worst case, causing bending of the penetrating prongs. If the penetration structures 45*a* and 45*b* are horizontally too far apart, the bale is not sliced cleanly. The preferred height differential of 2.5 inches minimizes this undesirable shearing and reduces power consumption. Because the preferred height differential of the two horizontal structure 45*a* and 45*b* is two and one half inches, the first horizontal structure 45*a* is initially set at a height of 12 inches above the top surface of the conveyor assembly loop member 128 before simultaneous penetration commences.

In FIG. 5 the word "push" refers to a movement of a rod member 86 or 111 out of the casing body structure 88 or 105, respectively, in which it is held to raise one or both sets of penetration structures 45 or to move one or both of the vertical track structures 40 away from the housing structure 36; and the word "pull" refers the movement of the rod 86 or 111 back into the casing body 88 or 105, respectively, to lower one or both penetration structures 45 or to move one or both of the vertical track structures 40 toward the housing structure 36. Column 1 in FIG. 5 describes the operation performed by splitter, column 2 indicates the distances traversed by each of the penetration structures 45*a* or 45*b* during the operation, column 3 gives the total time required for each operation and columns 4–6 is a timing diagram of the operations listed in column one where time is given in seconds along the top of columns 4, 5 and 6.

As indicated in FIG. 5, operations 1 and 2 occur simultaneously and involve inserting the first 45*a* and second 45*b* penetration structures into the bale simultaneously until each penetration structure 45 has penetrated the bale 22. The maximum horizontal movement of each structure 45*a* and 45*b* in a direction toward the bale conveyor assembly 41 is shown in FIGS. 2–4 and is determined in the preferred embodiment by the extent to which each of the rod members 111 can slide into a respective casing body structure 105 of the horizontal movement assembly 100 in which it is held. FIGS. 2 through 4 also show the position of the two penetration structures 45*a* and 45*b* after the completion of these first two simultaneous operations and before operation 3 has commenced. The simultaneous insertions which occur during the first and second operations are achieved by pulling both of the penetration structures 45 a preferred distance of approximately 48 inches from their initial or starting positions described above. The time required to complete this movement is preferably approximately 4.5 seconds. The simultaneity of these first two operations is indicated by the fact that the time lines for operations 1 and 2 shown in column 4 are of equal length and by the fact that the time line for operation 1 is directly below that for operation 2.

Operation 3 immediately follows the simultaneous completion of Operations 1 and 2. Operation 3 raises the first penetration structure 45*a* a preferred distance of 18 inches by pushing it for 2.4 seconds. The push is accomplished by the linear movement of the rod member 86 which is associated with the structure 45*a* out of its casing structure 88 to lift the respective vertical frame assembly. Thus, during this third operation the two penetration structures 45 cooperated to split a slice off of the bale 22; viz., the first penetration structure 45*a* raises an upper portion of the bale 22 a preferred distance of eighteen inches, although a range of ten to eighteen inches could be used, while the second penetration structure 45*b* holds a lower portion of the bale to be sliced off against the loop member 128. The second penetration structure 45*b* therefore remains motionless during the time period in which operation 3 is executed. The second penetration structure 45*b* is then retracted during operation 4 a distance of 48 inches by pushing it for a period of approximately 6.3 seconds so that the newly formed slice can be moved out of the tobacco splitter assembly 34 through the opposite end at which it entered by activating the continuous loop member 128 for 5 seconds during operation 5. Typically a conveyor mechanism downstream of the tobacco splitter assembly 34 is activated by the PLC 175 or by a switching device when the slice is moved out from the tobacco splitter assembly 34 which conveyor mechanism receives and transports the slice toward a plurality of devices which separate and condition the leaves, as will be described hereinbelow.

Following the completion of operation 4, the second penetration structure 45*b* is back in the same position it was in immediately prior to the commencement of operation 1; in other words, this second structure 45*b* is now in position to begin the bale slicing cycle again. Before this can happen, however, the bale 22 must be placed back on the loop member 128 and the first penetration structure 45*a* moved back into its original position. This occurs during operations 6 through 8. Operation 6 lowers the first penetration structure 45*a* thirty inches by pulling it for 2.8 seconds. The unsplit portion of the bale is placed back on the loop member 128 during Operation 7, which follows the completion of Operation 6; during Operation 7, the first penetration structure 45*a* retracts 48 inches by being pushed for 6.3 seconds horizontally away from the housing structure 36. The remainder of the bale 22 is prevented from being pulled off the top surface of the loop member 128 by the side walls 43. Finally, the first penetration structure 45*a* is raised in Operation 8 by pushing it for 1.6 seconds over a 12-inch distance. The splitter 34 is now ready to repeat these eight operations shown in FIG. 5 until the bale 22 on loop member 128 is completely split and the last slice of a particular bale leaves the tobacco splitter assembly 34. When the last slice leaves the splitter, a control signal from the PLC 175 activates the feed conveyor which places the next bale on the loop member 128 of the tobacco splitter assembly 34 and the above described splitting procedure is repeated.

Although this preferred method described in FIG. 5 of using the splitter assembly 34 to slice a tobacco bale produces slices having a thickness of approximately 9.5 inches, the proximity switches of the splitter can be used in a manner well known in the art to produce slices of any desired thickness. Thus, the horizontal height assumed by the penetration structures 45*a* and 45*b* is controlled by a plurality of proximity switches in a manner well known to one skilled in the art so the PLC 175 can be programmed to produce slices of any desired thickness. The sequence and timing of the above described operations can be varied by reprogramming the programmable logic control unit or by the intervention of a human operator monitoring the splitting assembly and the other devices cooperating therewith during a tobacco splitting and conditioning operation. Therefore it is within the scope of this invention to enable the PLC 175 to control and coordinate a plurality of devices that operate with the tobacco splitter assembly 34 in a tobacco conditioning process. It is also within the scope of the invention to program the PLC 175 to control the entire tobacco conditioning process, including the operation of the splitter assembly 34. The PLC controlled system can be interrupted by a human operator monitoring the tobacco processing and then PLC controlled operations can be resumed thereafter at any time at the discretion of the operator.

Using the Splitter in the Conditioning Process

Figure 9:
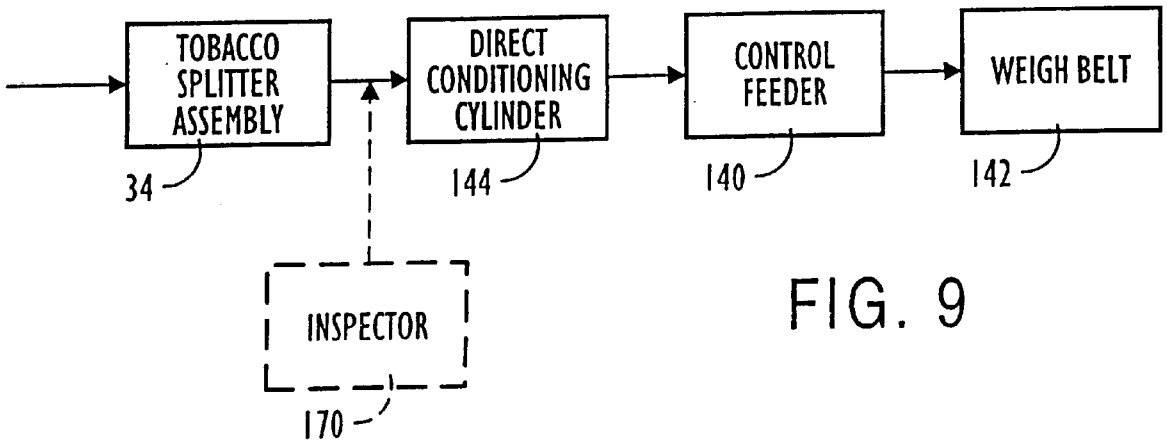
FIG. 9 is a block diagram of a sequence of steps for performing the preferred method of conditioning and separating baled tobacco leaves which incorporates the bale splitting assembly, a direct conditioning cylinder assembly and an optional inspection step shown in phantom.

It is frequently desired to condition and separate leaves of tobacco and a plurality of methods for the same are well known in the prior art. Tobacco farmers typically deliver their tobacco to market in sheets. Tobacco buyers frequently bale this sheeted tobacco into 1200 pound bales after it has been purchased from the tobacco farmers because baling the sheeted tobacco reduces freight costs and storage space requirements. The tobacco splitter assembly 34 described hereinabove and the conditioning and separating method illustrated in FIGS. 9 and 10 provide a means to slice bales of whole tobacco and condition the slices of whole leaves in a process that utilizes a direct conditioning cylinder, which is described hereinbelow. It should be noted that the tobacco splitter assembly and the conditioning and separating method illustrated in FIGS. 9 and 10 can be used to slice, separate and condition other forms of tobacco leaves including tobacco in strip form, but the splitter 34 and the method of FIGS. 9 and 10 also provide the tobacco processor with the capability of slicing baled whole leaf tobacco and separating and conditioning the same using a direct conditioning cylinder. The direct conditioning cylinder which is used in this method is also described hereinbelow. Before these are considered, however, the traditional or conventional method of processing tobacco will be examined.

Figure 6:
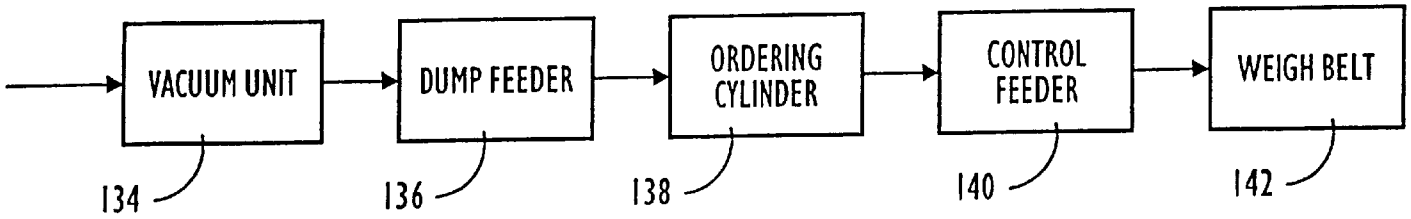
FIG. 6 PRIOR ART
FIG. 6 is a block diagram of the conventional method of conditioning and separating tobacco leaves.

Methods for conditioning and separating the loosely bundled sheeted leaves are well know and a block diagram for the conventional method for performing the same is shown in FIG. 6. If the leaf tobacco arrives for conditioning in compressed bales 22 incorporated into tobacco bale assemblies 20 as described above, then the preferred method for conditioning and separating the leaves is given in FIGS. 9 and 10. A block diagram for this preferred method of conditioning and separating the baled leaf tobacco 22 is shown in FIG. 9 and the preferred representation of a floor plan for effecting this preferred method is disclosed in FIG. 10. The traditional method of conditioning and separating leaves will be discussed first, then the preferred method for conditioning and separating the baled tobacco leaves 22 incorporated into the bale assemblies 20 will be examined and then the preferred modifications of the traditional method will be considered which modifications will enable the traditional system to be modified to advantageously process baled tobacco.

For a plurality of reasons, it is also frequently necessary and desirable to inspect the tobacco leaves before they begin the conditioning process or as they are being conditioned. An important reason why tobacco is inspected is to ensure that all tobacco that is about to be conditioned or is being conditioned is of an acceptable grade. Typically during the conditioning process, tobacco from a plurality of bales is moistened, separated into individual leaves or leaf parts and blended together. When the tobacco arrives for conditioning in tightly compressed bales, it is not possible to inspect the leaves in the bale as it would be if the leaves arrived for conditioning loosely packed in sheets. If baled tobacco of unknown quality is to be conditioned, it is possible that soil or tobacco of an unacceptable grade has been included in the bale. If these impurities are blended in with acceptable tobacco during the conditioning process, a great deal of waste can occur and therefore it is desirable to inspect the tobacco as is enters the conditioning process and human inspectors are typically and preferably employed to do this. Consequently, when either a modified form of the traditional method is used or the preferred method of FIGS. 9 and 10 is used to condition baled tobacco, it is preferable to include human inspectors in the process if tobacco of unknown quality is being conditioned and to modify the procedures accordingly. Therefore, phantom block representations of inspectors 170 are included in the drawings to indicate where in the process the inspection would preferably take place and although the presence of inspectors is optional, it is to be understood that in the preferred embodiment of each method, it is preferable to have an inspector present when a particular method is used to process tobacco of unknown quality and purity and to provide the inspector with control means for temporarily taking over control of the process from the PLC 175 and for halting the processing in the event that sub-grade tobacco, soil or other undesirable material is detected to prevent the same from being blended with other tobacco.

Referring now to the block diagram representation of the conventional method for conditioning loose tobacco in FIG. 6, it is shown that this traditional method includes a vacuum conditioner unit 134, a dump feeder 136, an ordering cylinder 138, a control feeder 140 and a weigh belt 142. The first step of the conditioning process in the conventional procedure is to place or feed a batch of the tobacco into a vacuum chamber within the vacuum conditioner unit 134. A vacuum is created within the vacuum conditioner unit 134 which is communicated to the tobacco in the vacuum chamber and which removes essentially all of the ambient atmospheric gases surrounding the tobacco and subjects the batch of tobacco to a strong vacuum. This vacuum is strong enough to effect the atmosphere within the pores of the leaves. Next, a carefully controlled amount of conditioned ambient atmospheric gasses having a carefully controlled temperature and moisture content is fed into the vacuum chamber of the vacuum conditioner unit 134 and maintained there for a predetermined period of time to make the leaves more pliable.

After the completion of this vacuum conditioning step, the batch of tobacco is removed from the vacuum conditioning unit 134 and placed in a blending line where it may be blended with tobacco leaves from a plurality of other batches. The leaves are then conveyed to the dump feeder 136, sometimes referred to as a bulk feeder, which feeds the mixed blended tobacco leaves into the ordering cylinder 138, which is frequently referred to as a conditioning cylinder. Ordering cylinders 138 are well known in the art and typically include a drum portion which is rotatably mounted therein and which rotates about a downwardly sloping axis so that the tobacco which has been fed into the proximal end thereof advances to the distal end thereof by the combined action of the rotation and gravity. The bulk feeder 136 feeds the tobacco leaves into an inner peripheral portion of the open proximal end of the ordering cylinder 138 where a plurality of spikes mounted on the inner periphery break up the large clumps of leaves as they rotate with the drum portion until the leaves fall through the open turning cylinder. A flow of conditioned heated air is introduced into the conditioning cylinder 138 at the upper inner periphery thereof that further conditions the leaves as they advance through the rotating cylinder. An optional spray apparatus may be provided at the distal end of the ordering cylinder 138 to ensure that the leaves contain the proper amount of moisture when they exit the cylinder. Upon leaving the ordering cylinder 138, the leaves go to the weigh belt feeder where they are further broken up and fed to a weighing belt device which weighs the leaves and controls the rate of flow of the leaves as they exit the conditioning system and makes the leaf flow of the conditioned and loosened leaves more even. This controlled flow of leaves is then sent for further processing.

The preferred method for conditioning and separating the baled whole tobacco leaves is shown in FIGS. 9 and 10. The concept of splitting cases of tobacco in strip form, that is, with the stem removed, and conditioning the same using a direct conditioning cylinder has been known for many years. The tobacco splitting assembly 34 disclosed herein, however, is can split bales of whole leaf tobacco into slices and the method of separating and conditioning baled tobacco leaves illustrated in FIGS. 9 and 10 using a direct conditioning cylinder can also be used to condition and separated whole leaf tobacco, including baled whole leaf tobacco and sheeted whole leaf tobacco.

Two important differences in the preferred method over the traditional method are that the vacuum conditioner unit 134 and the conventional ordering cylinder 138 have been eliminated and a direct conditioning cylinder 144 and the tobacco splitter assembly 34 have been included. Eliminating the vacuum conditioning unit is advantageous because the units are expensive to buy and maintain and vacuum conditioning typically takes a proportionately large amount of time and consumes a large quantity of energy. Conditioning an entire bale of tobacco typically requires about one half of one hour. The direct conditioning cylinder includes at least one rotating cylinder which may be provided about an interior rotating surface thereof with a plurality of axially inwardly extending internal projections such as spikes, paddles, blades or similar structures to lift and drop the slices and fragments of baled tobacco to separate them. The rotating cylinder rotates about a downwardly sloping longitudinal axis to gravitationally advance the tobacco to the distal or delivery end thereof during rotation. The interior of the direct conditioning cylinder can further include a plurality of steam or water conduits that can be variously located to communicate heat, moisture or conditioning chemical agents to the rotating tobacco.

The direct conditioning cylinder 144 differs from the ordering cylinder 138 in several ways including the fact that the heated air which conditions the tobacco enters the direct conditioning cylinder 144 at the lower periphery thereof rather than at the upper periphery as it does in the ordering cylinder 138. The direct conditioning cylinder 144 is preferably used in tandem with the tobacco splitter assembly 34 because breaking up the compressed bales into slices makes conditioning and separating them easier.

The preferred procedure for conditioning the baled leaf tobacco includes the splitter assembly 34 and the direct conditioning cylinder 144 and the details of this procedure can be understood by reference to the schematic of the floor plan in FIG. 10, which procedure typically commences with the following steps: the steel bands 30, the top member 26 and bale covering structure 28 are removed from the tobacco bale assembly 20 and the bale 22 and the base member 24 are lifted, typically by a forklift with rotatable clamps, and placed onto the feed mechanism called the feed conveyor 146. During this movement of the bale 22 and the base member 24, the lift rotates the bale and base member so that the base member 24 is now on top of the bale. Once the bale and base member are released by the clamps of the forklift, the base member 24 is removed by hand and the bale is now ready to be moved into the tobacco splitter assembly 34. After the base member is removed the feed conveyor 146 moves the bale 22 to the entrance of the tobacco splitter assembly 34 and places it on the bale conveyor assembly which transports the bale 22 to the center of the splitter mechanism 34 in position to be split. The bale 22 is placed on the feed conveyor 146 so that the leaf surfaces are parallel to the surface of the feed conveyor on which it rests. This orientation positions the cleavage planes formed by the leaves essentially horizontally so the bale can be split without damaging the leaves.

The bale 22 is split in the manner set forth above in the section under the heading "Operation of the Splitter" into a plurality of slices which leave the tobacco splitter assembly 34 one at a time. The tobacco splitter assembly 34 slices the bale repeatedly until the last slice leaves the assembly 34, whereupon the next bale 22 enters the tobacco splitter assembly 34. The speed at which the slices leave the tobacco splitter assembly 34 is predetermined by an operator 180 who programs a desired flow rate of slices into the PLC 175. Specifically, a scale conveyor 148, also known as a weigh scale, which is positioned downstream of the tobacco splitter assembly 34 weighs each slice of the tobacco bale 22 and sends a control or feedback signal back to the PLC 175; the PLC 175 then, based on the selected flow-rate of the tobacco into the direct conditioning cylinder 144 chosen by the operator 180, determines when the following slice should leave the splitter assembly 34. Controlling the operation of a machine using a feedback signal sent from a weigh scale to a PLC is well known in the art. The size of the slice is also within the control of the operator 180 who can reprogram the PLC 175 and the optimum slice thickness is determined by many factors. Cooperation between the nature of the slice and the capacity of the direct conditioning cylinder 144 allows the tobacco to be conditioned without extensive damage to the leaves as frequently occurred in previous methods. Alternatively, the flow-rate of tobacco can also be regulated by programming the PLC 175 to convey a tobacco slice out of the tobacco splitter assembly 34 at predetermined time intervals. Hence, a tobacco slice could exit the tobacco splitter assembly 34 and be directed to the direct conditioning cylinder 144 at regular time intervals and this time interval could be changed at the discretion of the PLC programmer.

Figure 11:
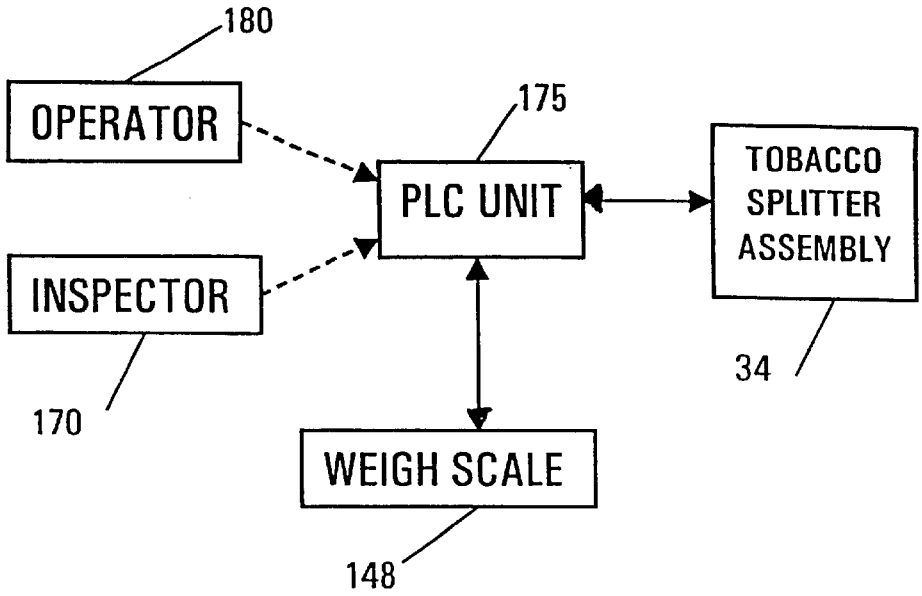
FIG. 11 is a block diagram showing a programmable logic control unit controlling the operation of a tobacco splitter assembly in response to a signal from a weigh scale.

FIG. 11 shows a block diagram of the PLC 175 controlling the operation of the tobacco splitter assembly 34 and a feedback signal going from the weigh scale 148 to the PLC 175 to indicate the rate at which tobacco slices leave the splitter assembly 34. The double headed arrow between the PLC 175 and the tobacco splitter assembly indicate that it is possible for the PLC to receive feedback signals from the splitter. The double headed arrow between the PLC and the weigh scale indicate that it is also possible for the operator to program the PLC to send control signals to the weigh scale. The dotted lines from the operator 180 to the PLC 175 indicate that the operator can predetermine the rate at which slices leave the splitter by programming the PLC 175. The broken line from the inspector 170 to the PLC 175 indicates that the inspector 170 can interrupt the PLC 175 if necessary.

The slices go directly from the tobacco splitter assembly 34 by means of a plurality of conveyor mechanisms into the direct conditioning cylinder 144 where they are conditioned and separated into individual leaves. In the floor plan shown in FIG. 10, a slightly inclined conditioner conveyor 150 moves the tobacco from the weigh scale 148 to the proximal, or intake, end of the direct conditioning cylinder 144. The preferred angle of inclination of the conditioner conveyor is about 20 degrees.

After completion of the conditioning process, the conditioned tobacco exits the direct conditioning cylinder 144 and is propelled by a slightly inclined conveyor 154 to an oscillator 156 and a flow-regulating feeder 158. The preferred angle of inclination of the conveyor 154 is about nineteen degrees. A carefully controlled amount of the tobacco then passes out of the flow-regulating feeder 158 along the conveyor 159 to a weigh belt 160 which feeds a controlled amount of the conditioned tobacco to a picking conveyor 162 for picking. The speed of the flow-regulating feeder 158 is controlled by the weigh belt 160 and the PLC 175 according to a set-point selected by the operator.

A plurality of structures are positioned to feed or refeed tobacco into the conditioning process without going through the tobacco splitter assembly 34. A portable conveyor assembly 152 is positioned to feed tobacco downstream of the tobacco splitter assembly 34 and upstream of the weigh scale assembly 148. Preferably the moving surface of the portable conveyor assembly 152 is inclined. A floor sweeper 164 is used to feed tobacco back to the conditioner conveyor 150. A refeed assembly 166 is also positioned to refeed tobacco back to the conditioning conveyor 118 along the same plurality of conveyors 159 used by the floor sweeper 164.

Although the preferred method for conditioning and separating the leaves of baled tobacco is that illustrated in FIGS. 9 and 10, many of the existing processing sites for conditioning tobacco are of the traditional type shown in FIG. 6 which incorporate the vacuum unit 134 and the ordering cylinder 138. Therefore, it is frequently desirable to have a method for modifying traditional conditioning facilities to allow them to be used for processing the baled tobacco 22 incorporated in the tobacco bale assembly 20. Because the traditional facilities incorporate the use of vacuum conditioning units 134 therein instead of direct conditioning cylinders 144, a method for processing baled tobacco by modifying a conventional processing plant would include vacuum conditioning either the split or unsplit baled tobacco as a step in the process.

As mentioned previously, inspecting the tobacco prior to or during the conditioning process is often necessary regardless of the method used to condition and separate the leaves in order to ascertain whether or not the tobacco contained in the bales is of an acceptable. Because tobacco arrives for conditioning in compressed bales 22 incorporated in the bale assemblies 20, it is impossible to visually inspect the tobacco until the bales have been split apart and so the possibility exists that tobacco of an unacceptable grade or clumps of soil or sand have been incorporated into a tobacco bale. Therefore it is important for an inspector 170 to examine the grade and purity of the tobacco after it is split and for the inspector 170 to have the ability to halt the processing equipment when a problem is discovered so that the substandard tobacco or the impurities can be prevented from blending with the acceptable grade tobacco.

Figure 7:
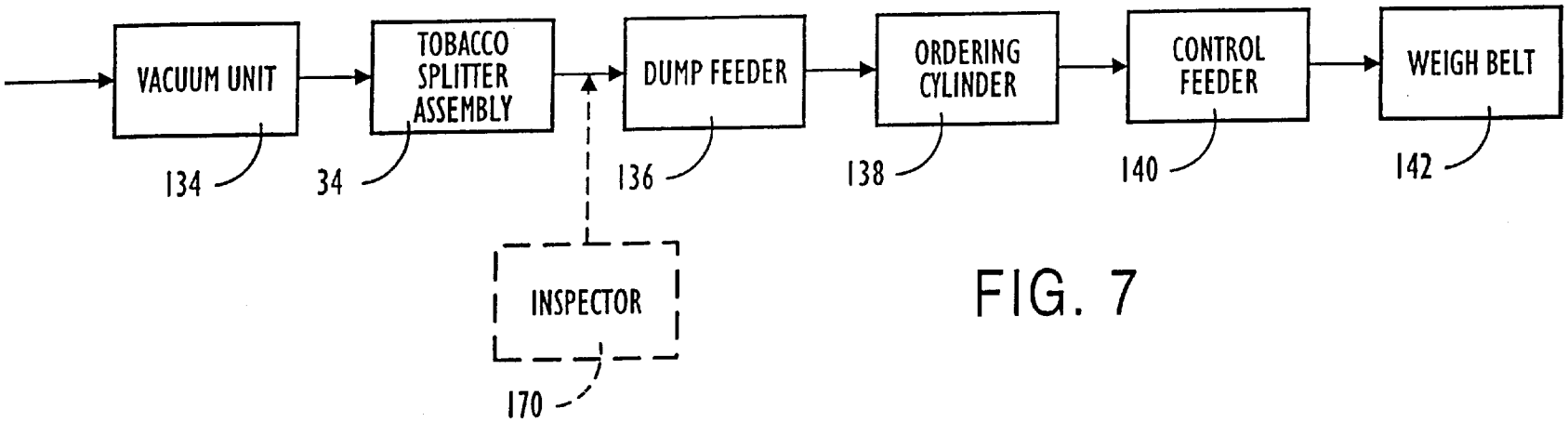
FIG. 7 is a block diagram showing a first way the conventional method can be modified to accommodate baled tobacco by incorporating a bale splitting step performed by the bale splitting assembly in a first position and showing the preferred position of an optional inspection step when this first modification of the traditional method is used.
Figure 8:
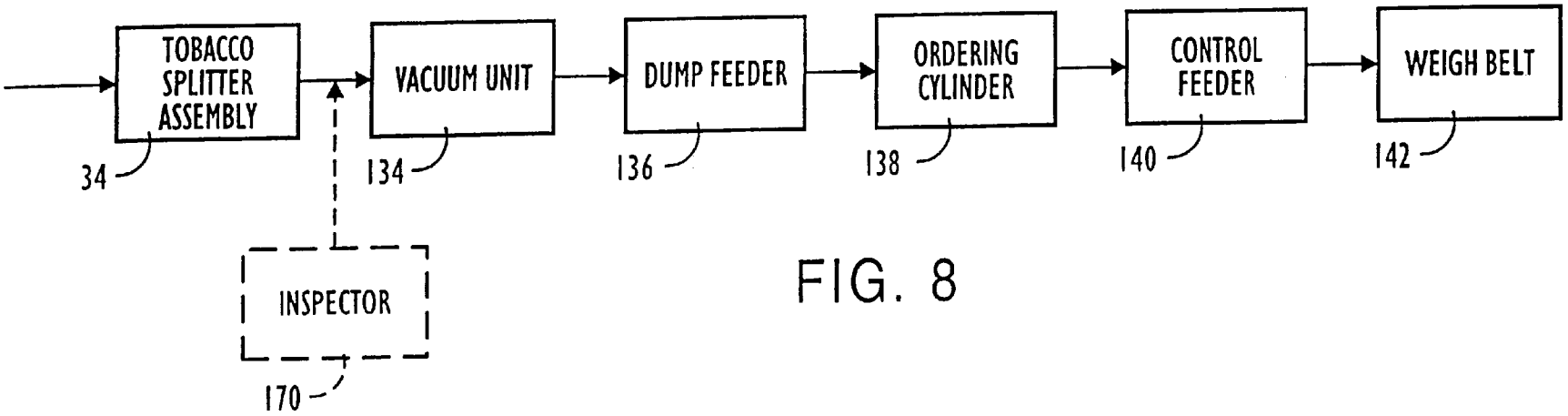
FIG. 8 is a block diagram showing a second way the conventional method can be modified to accommodate baled tobacco by incorporating a bale splitting step performed by the bale splitting assembly in a second position and showing the preferred position of an optional inspection step when this second modification of the traditional method is used.

When the modified traditional procedure is used, the tobacco may be split before or after vacuum conditioning, depending on the layout of the plant, among other factors. If the tobacco splitter assembly 34 is incorporated into the process prior to, or upstream of, the vacuum conditioning step 134, the inspection step 170 is preferably performed prior to vacuum conditioning 134 as indicated in FIG. 8 by the position of the inspection step 170 which is shown in phantom. If the facility has been set up to vacuum condition the bale of tobacco 22 prior to splitting, it is preferred to have the inspection take place after vacuum conditioning and after the splitting, but prior to placing the tobacco into the ordering cylinder 138. This embodiment is shown in FIG. 7 with the inspection step 170 shown in phantom. When the tobacco bale 22 is conditioned and separated using the preferred method shown in FIGS. 9 and 10 which incorporates the direct conditioning cylinder, the inspection preferable occurs prior to the tobacco entering the direct conditioning cylinder 144 and more preferably still, the inspection 170 takes place prior to the tobacco arriving at the weigh scale 148. This preferred position is shown in phantom in both FIGS. 9 and 10.

It is to be understood that the foregoing detailed description is provided to illustrate the structural and functional principles of the present invention and is not intended to be limiting. To the contrary, the present invention is intended to encompass any alterations, modifications, and equivalents within the scope of the appended claims.

It should be noted that the appended claims do not contain limitations expressed in the 'means for performing a specified function' format of 35 U.S.C. §112, ¶6. This is to clearly point out that the applicant does not intend the claims to be interpreted under 35 U.S.C. §112, ¶6, so as to be limited solely to the structures disclosed in the present application and their structural equivalents.

What is claimed:

1. A tobacco bale slicing apparatus for slicing a bale of compressed tobacco having a plurality of substantially whole, generally parallel tobacco leaves having stems, said apparatus comprising:

first bale penetrating structure having a plurality of prongs constructed and arranged to penetrate the bale generally parallel to the flattened tobacco leaves;

second bale penetrating structure having a plurality of prongs constructed and arranged to penetrate the bale generally parallel to the flattened tobacco leaves;

a penetrating structure moving assembly having structure constructed and arranged to (1) move said first penetrating structure generally perpendicularly relative to the flattened tobacco leaves to a first pre-penetrating position wherein said prongs thereof are disposed outside of the bale and at a first level spaced generally perpendicularly to the tobacco leaves from an edge of the bale and corresponding to a desired thickness of a bale slice to be separated from the bale and (2) move said second penetrating structure generally perpendicularly to the flattened tobacco leaves to a second pre-penetrating position wherein said prongs thereof are disposed outside of the bale and at a second level offset relative to said first level in a direction extending generally perpendicularly to the tobacco leaves;

said penetrating structure moving assembly having structure constructed and arranged to move said bale penetrating structures from said respective first and second pre-penetrating positions generally parallel to the flattened tobacco leaves to respective first and second penetrated positions wherein said first and second penetrating structure prongs penetrate the bale at said first and second levels, respectively, so as to define the aforesaid bale slice of the desired thickness and a remaining portion of the bale;

said penetrating structure moving assembly having structure constructed and arranged to move said first and second bale penetrating structures relatively away from one another generally perpendicularly to the flattened tobacco leaves so as to separate the bale slice from the remaining portion of the bale after said first and second penetrating structure prongs have penetrated the bale;

a bale slice moving assembly having structure constructed and arranged to move the separated bale slice away from the remaining portion.

2. A tobacco bale slicing apparatus according to claim 1, wherein said bale slice moving structure is a tobacco bale moving and supporting assembly providing an upwardly facing bale supporting surface positioned to support the bale with the flattened tobacco leaves thereof extending generally parallel to the supporting surface;

said penetrating structure moving assembly comprising first and second penetrating structure moving assemblies, said first and second penetrating structure moving assemblies being constructed and arranged to move said first and second bale penetrating structures, respectively, generally vertically to said first and second pre-penetrating positions, said first level being spaced from a bottom edge of the bale and corresponding to the desired thickness of the bale slice to be separated from the bottom of the bale;

said first and second penetrating structure moving assemblies being constructed and arranged to move said first and second bale penetrating structures, respectively, generally horizontally such that said first and second penetrating structure prongs penetrate the bale at said first and second levels;

said first and second penetrating structure moving assemblies being constructed and arranged such that, after said bale penetrating structures have penetrated the bale, said second penetrating structure moving assembly moves said second bale penetrating structure upwardly away from said bale supporting surface to lift the remaining portion of the bale while said first bale penetrating structure remains stationary with respect to said bale supporting surface and prevents the bale slice from moving upwardly so as to separate the bale slice from the bottom of the bale;

said tobacco bale moving and supporting assembly being constructed and arranged to move the separated bale slice outwardly from below the tobacco bale after raising said second bale penetrating structure;

said first and second penetrating structure moving assemblies being constructed and arranged such that, after the separated bale slice has been moved outwardly from below the tobacco bale, said first penetrating structure moving assembly moves said first penetrating structure out from under the bale and then said second penetrating structure moving assembly lowers said second penetrating structure and the remaining portion of the bale to said bale supporting surface;

said second penetrating structure moving assembly being constructed and arranged to move said second penetrating structure out from under the remaining portion after the remaining portion is lowered such that said tobacco slicing apparatus is ready to separate another slice from the bottom of the bale.

3. A tobacco bale slicing apparatus according to claim 2, wherein said first and second penetrating structures are disposed on opposing sides of said tobacco bale moving and supporting assembly;

said first bale penetrating structure prongs extending generally toward said second bale penetrating structure;

said second penetrating structure prongs extending generally toward said first bale penetrating structure;

said first and second bale penetrating prongs being offset relative to one another in a direction extending generally parallel to said bale supporting surface such that, when said bale penetrating structures penetrate the bale, said first and second bale penetrating prongs are arranged in an alternating manner in the direction extending generally parallel to the bale supporting surface.

4. A tobacco bale slicing apparatus according to claim 3, wherein said first penetrating structure moving assembly comprises:

a first horizontal track assembly;

a first vertical track assembly rollingly mounted to said first horizontal track assembly for guided horizontal movement relative to the bale, said first bale penetrating structure being rollingly mounted to said first vertical track assembly for guided vertical movement relative to said bale supporting surface of said tobacco bale supporting and moving assembly;

a first horizontal movement assembly operatively connected to said first vertical track assembly, said first horizontal movement assembly being constructed and arranged to horizontally move said first vertical track assembly and said first bale penetrating structure generally parallel to the tobacco leaves; and a first vertical movement assembly operatively connected to said first bale penetrating structure, said first vertical movement assembly being constructed and arranged to vertically move said first penetrating structure vertically relative to said bale supporting surface along said first vertical track assembly;

said second penetrating structure moving assembly comprising:

a second horizontal track assembly;

a second vertical track assembly rollingly mounted to said second horizontal track assembly for guided horizontal movement relative to the bale, said second bale penetrating structure being rollingly mounted to said second vertical track assembly for guided vertical movement relative to said bale supporting surface of said tobacco bale supporting and moving assembly;

a second horizontal movement assembly operatively connected to said second vertical track assembly, said second horizontal movement assembly being constructed and arranged to horizontally move said second vertical track assembly and said second bale penetrating structure generally parallel to the tobacco leaves; and a second vertical movement assembly operatively connected to said second bale penetrating structure, said second vertical movement assembly being constructed and arranged to vertically move said second penetrating structure vertically relative to said bale supporting surface along said second horizontal track assembly.

5. A tobacco bale slicing apparatus according to claim 4, wherein said tobacco bale moving and supporting assembly is a conveyor belt assembly comprising:

a plurality of rollers;

an endless belt extending around and engaged with said rollers; and a conveyor belt moving device constructed and arranged to impart rotation to at least one of said rollers so as to move said endless belt and move the separated bale slice outwardly from under the tobacco bale.

6. A tobacco bale slicing apparatus according to claim 5, wherein said first bale penetrating structure has a plurality of rollers disposed on opposing sides thereof;

said first vertical track assembly including a pair of first vertical track members extending upwardly from said first horizontal track assembly, said plurality of rollers on said first bale penetrating structure being rollingly received within said vertical track members for guided vertical movement relative to said bale supporting surface;

said second bale penetrating structure having a plurality of rollers disposed on opposing sides thereof;

said second vertical track assembly including a pair of second vertical track members extending upwardly from said second horizontal track assembly, said plurality of rollers on said second bale penetrating structure being rollingly received within said second vertical track members for guided vertical movement relative to said bale supporting surface.

7. A tobacco bale slicing apparatus according to claim 6, wherein said first vertical frame assembly comprises a pair of first base members fixedly attached to lower end portions of said first vertical track members, said first base members having a plurality of rollers attached thereto;

said first horizontal track assembly comprising a pair of first horizontal track members extending generally in said first penetrating direction, said plurality of rollers on said first base members being rollingly received within said first horizontal track members for guided movement of said first bale penetrating structure in and opposite to said first penetrating direction;

said second vertical frame assembly comprising a pair of second base members fixedly attached to lower end portions of said second vertical track members, said second base members having a plurality of rollers attached thereto;

said second horizontal track assembly comprising a pair of second horizontal track members extending generally in said second penetrating direction, said plurality of rollers on said second base members being rollingly received within said second horizontal track members for guided movement of said second bale penetrating structure in and opposite to said second penetrating direction.

8. A tobacco bale slicing apparatus according to claim 7, wherein said first and second horizontal movement assemblies are horizontally aligned retractable and extensible hydraulic pistons;

said first and second vertical movement assemblies being vertically aligned extensible and retractable hydraulic pistons;

said vertically and horizontally aligned hydraulic pistons being fluidly communicated to a hydraulic fluid pressure source.

9. A tobacco bale slicing apparatus according to claim 8, further comprising a pair of generally vertically extending walls disposed on opposing sides of said conveyor belt assembly;

said generally vertically extending walls each having a plurality of prong receiving openings formed therethrough, said prong receiving openings being positioned and configured such that, when said first and second penetrating prongs penetrate the bale of tobacco, said penetrating prongs extend through the prong receiving openings.

10. A tobacco bale slicing apparatus according to claim 8, further comprising:

a bale position sensor communicated with said conveyor belt assembly;

said bale position sensor being adapted such that, as said conveyor belt moves the tobacco bale relative to said bale penetrating structure and into a position prior to slicing, said sensor senses when the bale is substantially centered with respect to said bale penetrating structures and signals said conveyor belt assembly to stop movement of the bale.

11. A tobacco bale slicing apparatus according to claim 1, wherein operation of said penetrating structure moving assembly is computer controlled.

* * * * *